US010342094B1

(12) United States Patent
Goldstein et al.

(10) Patent No.: US 10,342,094 B1
(45) Date of Patent: Jul. 2, 2019

(54) LIGHTING DEVICE WITH ACTIVE THERMAL MANAGEMENT

(71) Applicant: Cree, Inc., Durham, NC (US)

(72) Inventors: Corey Goldstein, Milwaukee, WI (US); Kurt Wilcox, Libertyville, IL (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 15/846,306

(22) Filed: Dec. 19, 2017

(51) Int. Cl.
*H05B 37/02* (2006.01)
*H05B 33/08* (2006.01)
*F21K 9/61* (2016.01)

(52) U.S. Cl.
CPC ..... *H05B 33/0884* (2013.01); *F21K 9/61* (2016.08); *H05B 37/0227* (2013.01); *H05B 37/0245* (2013.01); *H05B 37/0272* (2013.01)

(58) Field of Classification Search
CPC ..... H05B 37/0227; H05B 37/0245; H05B 37/0272; H05B 37/0281
USPC ..... 315/307, 309
See application file for complete search history.

(56) References Cited

U.S. PATENT DOCUMENTS 8,395,693 B2 3/2013 Iijima et al.
8,736,186 B2 5/2014 Chobot
8,829,821 B2 9/2014 Chobot et al.
8,912,735 B2 12/2014 Chobot et al.
8,975,827 B2 3/2015 Chobot et al.
9,155,165 B2 10/2015 Chobot
9,155,166 B2 10/2015 Chobot
9,433,061 B2 5/2016 Chobot
9,572,226 B2 2/2017 Motley et al.
9,622,321 B2 4/2017 Creasman et al.
9,786,639 B2 10/2017 Bergmann et al.
9,818,919 B2 11/2017 Lowes et al.
2010/0289410 A1* 11/2010 Wu ..... H05B 33/0854 315/112
2011/0309754 A1* 12/2011 Ashdown ..... H05B 33/0818 315/151
2012/0146066 A1* 6/2012 Tischler ..... H01L 27/156 257/89
2012/0146548 A1 6/2012 Campbell et al.
2013/0293147 A1* 11/2013 Rogers ..... H05B 33/086 315/297
2013/0294086 A1* 11/2013 Mayer ..... F21V 7/048 362/346

(Continued)

FOREIGN PATENT DOCUMENTS

WO 2013063678 A1 5/2013

OTHER PUBLICATIONS

U.S. Appl. No. 61/932,058, filed Jan. 27, 2014.

(Continued)

*Primary Examiner* — Tung X Le
(74) *Attorney, Agent, or Firm* — Myers Bigel, P.A.

(57) ABSTRACT

A LED lighting device includes a temperature sensitive component having a temperature limit. A driver controls current delivered to the at least one LED and includes a temperature sensor for determining a temperature of the driver. A controller stores a correlated temperature limit of the driver, the controller controls the driver to reduce the current delivered to the LEDs when the correlated temperature limit is reached. The correlated temperature limit is the temperature of the driver when the temperature of the temperature sensitive component reaches its temperature limit.

19 Claims, 6 Drawing Sheets

(56) References Cited

U.S. PATENT DOCUMENTS

| | | | | |
|---|---|---|---|---|
| 2014/0268790 | A1 | 9/2014 | Chobot et al. | |
| 2016/0143109 | A1* | 5/2016 | Lal | F21V 29/70 315/294 |
| 2016/0249428 | A1* | 8/2016 | Bandel | H05B 33/0854 |

OTHER PUBLICATIONS

U.S. Appl. No. 62/292,528, filed Feb. 8, 2016.
Invitation to Pay Additional Fees and, Where Applicable, Protest Fee, for corresponding International Application No. PCT/US2018/065595, mailing date Feb. 25, 2019, 12 pgs.
Notification of Transmittal of the International Search Report and the Written Opinion of the International Searching Authority, or the Declaration, for corresponding International Application No. PCT/US2018/065595, dated Apr. 16, 2019, 18 pages.

* cited by examiner

LIGHTING DEVICE WITH ACTIVE THERMAL MANAGEMENT

BACKGROUND OF THE INVENTION

The invention relates to lighting fixtures and, more particularly, to luminaires that are well-suited for use with solid state lighting sources, such as light emitting diodes (LEDs).

Lighting devices are ubiquitous in residential, commercial, office and industrial spaces throughout the world. More recently, with the advent of efficient solid state lighting sources, these lighting devices have been used with LEDs as the light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED. The light output intensity is typically directly proportional to the forward current flowing through the LEI).

Heat may adversely affect the operation of a LED lighting device. Excessive heat may degrade the performance of, or cause a failure of, the LEDs or other components including the LED driver. Thermal management is used with solid state lighting devices to manage the heat generated in the system. To manage heat, LED lighting devices may use passive heat management systems such as mechanical heat sinks, gas convection or the like. Such passive systems may not be capable of dissipating enough heat from the lighting device under all conditions. In response, active heat management systems have been developed. One such system uses a circuit on the LED board that includes a thermistor. The thermistor provides a resistant load that sends a feedback signal to a dimmer circuit for the LEDs. As the set temperature limit is reached, the dimmer circuit dims the LEDs by effectively lowering the current delivered to the system thereby reducing the heat generated. The LEDs are dimmed until the thermistor drops below the set temperature limit. The cycle is repeated to maintain the temperature below the set temperature limit. The use of a thermistor on the LED board and the feedback circuit to the dimmer circuit requires more system components thereby increasing the cost of the system and lowering reliability. LED systems may also use driver temperature limits to protect the driver from overheating. In such a system the driver itself includes a temperature sensor and feedback that reduces power to the LEDs when the temperature limit of the driver is reached. While such a system protects the driver against overheating it does not necessarily protect other components in the system from overheating.

SUMMARY OF THE INVENTION

In some embodiments, a lighting device comprises at least one LED operable to emit light when energized through an electrical path and a temperature sensitive component having a temperature limit. A driver is in the electrical path for controlling current delivered to the at least one LED. The driver comprises a temperature sensor for determining a temperature of the driver. A controller stores a correlated temperature limit of the driver, the controller controlling the driver to reduce the current delivered to the LEDs when the correlated temperature limit is reached. The correlated temperature limit is related to the temperature limit whereby overheating of the temperature sensitive component is prevented.

The temperature sensitive component may be an optical element. The optical element may be a TIR optical element. The driver may comprise at least one of a buck converter, boost converter, buck-boost converter, or single ended primary inductor converter. The driver may comprise dimming control circuitry. The driver may comprise a programmable driver. The correlated temperature may be the temperature of the driver when the temperature of the temperature sensitive component reaches the temperature limit. The correlated temperature may include a margin of safety. The driver may have a temperature limit where the correlated temperature is lower than the temperature limit of the driver. The controller may store a threshold temperature, the controller controlling the driver to increase the current delivered to the LEDs when the threshold temperature is reached. The driver may have a driver temperature limit and the temperature limit of the temperature sensitive component may be higher than the driver temperature limit.

In some embodiments a method of operating a lighting device comprises energizing at least one LED through an electrical path to emit light; operating a driver in the electrical path to control current delivered to the at least one LED; sensing the temperature of the driver; storing a correlated temperature limit, the correlated temperature limit being related to the temperature limit of a temperature sensitive component other than the driver; controlling the driver to reduce the current delivered to the LEDs when the temperature of the driver reaches the correlated temperature limit, whereby overheating of the temperature sensitive component is prevented.

The temperature sensitive component may be optical element that receives the light emitted from the at least one LED The correlated temperature may be the temperature of the driver when the temperature of the temperature sensitive component reaches the temperature limit. The correlated temperature may include a margin of safety. The method may comprise increasing the current delivered to the LEDs when a threshold temperature is reached.

In some embodiments a method of making a lighting device having at least one LED and a driver for controlling current delivered to the at least one LED comprises measuring a first temperature of at least one temperature sensitive device; measuring a second temperature at a driver; determining a correlated temperature of the second temperature when the first temperature reaches a temperature limit of the temperature sensitive device; and storing the correlated temperature to control the operation of the driver.

The method may comprise operating the lighting device to raise the temperature in the system higher than normal operating conditions. The step of measuring a first temperature of at least one temperature sensitive device may comprise the measuring of the first temperature of multiple temperature sensitive components. The method may further comprise programming the correlated temperature in the driver.

DETAILED DESCRIPTION OF EMBODIMENTS OF THE INVENTION

Figure 1:
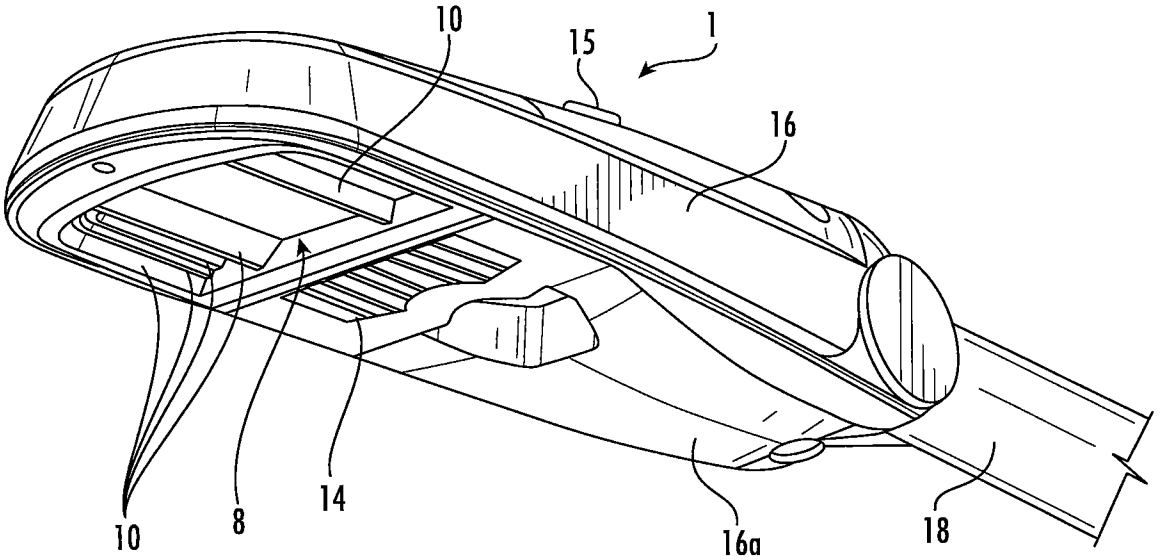
FIG. 1 is a perspective view of an embodiment of a lighting device in which the system of the invention may be used.
Figure 2:
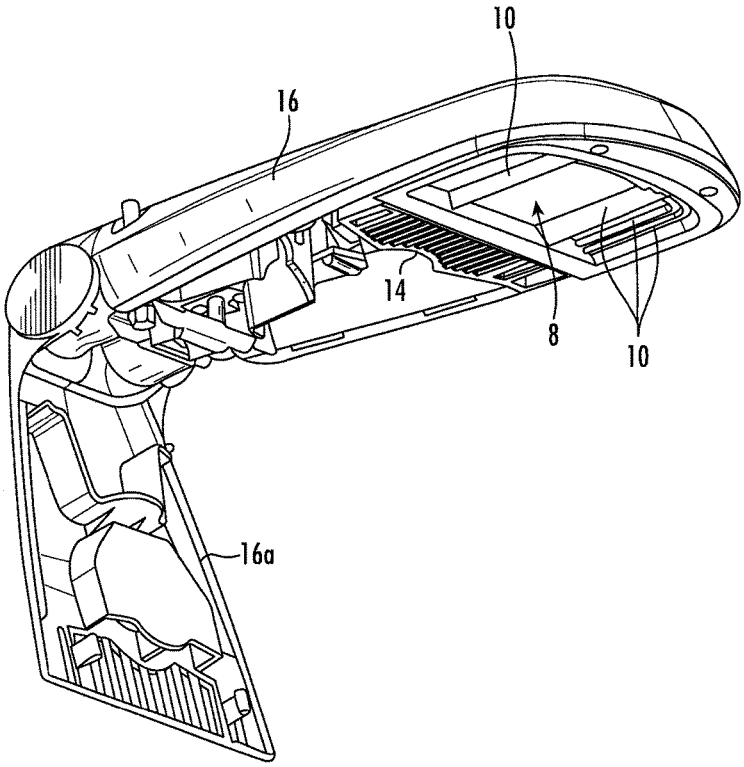
FIG. 2 is a view of the lighting device of FIG. 1 with an access door open.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Embodiments of the present invention entail digital and/or analog communication between a controller for a solid state lamp and a driver or power supply unit that is supplying power to the LEDs. The term "controller" is used herein in the broadest sense. A controller can be a microcontroller, microprocessor, digital signal processor, embedded processor, programmed logic array, dedicated hard-wired circuitry, or any other electronics used to perform control functions. If a programmable device such as a microcontroller is used, firmware, software, or microcode can be stored in a tangible medium that is associated with the device. Such a medium may be a memory integrated into the controller, or may be a memory chip that is addressed by the controller to perform control functions. Such firmware, software or microcode is executable by a controller and when executed, causes the controller to perform its control functions.

Referring to FIGS. 1-4 an embodiment of a solid state lighting device 1 is shown. Lighting device 1 comprises one or more LEDs 2, and typically a plurality of LEDs, mounted on an LED board 4. The LED board 4 may be any appropriate board, such as a PCB, flexible circuit board, metal core circuit board or the like with the LEDs 2 mounted and interconnected thereon. The LED board 4 can include the electronics and interconnections necessary to deliver power the LEDs 2. The LED board 4 may provide the physical support for the LEDs 2 and may form part of the electrical path to the LEDs for delivering current to the LEDs.

The term "electrical path" is used to refer to the entire electrical path to the LEDs 2, including an intervening power supply or driver 6 and the electronics in the lamp disposed between the source of electrical power and the LEDs. Electrical conductors (not shown) run between the LEDs, the lamp electronics and the source of electrical power, such as a buildings electrical grid, to provide critical current to the LEDs 2.

Details of suitable arrangements of the LEDs and lamp electronics for use in the light fixture 1 are disclosed in U.S. Pat. No. 9,786,639, entitled "Solid State Light Fixtures Suitable for High Temperature Operation Having Separate Blue-Shifted-Yellow/Green and Blue-Shifted-Red Emitters" issued on Oct. 10, 2017, which is incorporated by reference herein in its entirety. In other embodiments, all similarly colored LEDs may be used where for example all warm white LEDs or all warm white LEDs may be used where all of the LEDs emit at a similar color point. In such an embodiment all of the LEDs are intended to emit at a similar targeted wavelength; however, in practice there may be some variation in the emitted color of each of the LEDs such that the LEDs may be selected such that light emitted by the LEDs is balanced such that the lamp emits light at the desired color point. In the embodiments disclosed herein a various combinations of LEDs of similar and different colors may be selected to achieve a desired color point. Each LED element or module may be a single white or other color LED chip or other bare component, or each may comprise multiple LEDs either mounted separately or together on a single substrate or package to form a module including, for example, at least one phosphor-coated LED either alone or in combination with at least one color LED, such as a green LED, a yellow LED, a red LED, etc. In those cases where a soft white illumination with improved color rendering is to be produced, each LED element or module or a plurality of such elements or modules may include one or more blue shifted yellow LEDs and one or more red LEDs. The LEDs may be disposed in different configurations and/or layouts as desired. Different color temperatures and appearances could be produced using other LED combinations, as is known in the art. In one embodiment, the light source comprises any LED, for example, an MT-G LED incorporating True-White® LED technology or as disclosed in U.S. Pat. No. 9,818,919, issued Nov. 14, 2017, entitled "LED Package with Multiple Element Light Source and Encapsulant Having Planar Surfaces" by Lowes et al., the disclosure of which is hereby incorporated by reference herein in its entirety, as developed and manufactured by Cree, Inc., the assignee of the present application. In any of the embodiments disclosed herein the LEDs 32 may have a lambertian light distribution, although each may have a directional emission distribution (e.g., a side emitting distribution), as necessary or desirable. More generally, any lambertian, symmetric, wide angle, preferential-sided, or asymmetric beam pattern LED(s) may be used as the light source. Various types of LEDs may be used, including LEDs having primary optics as well as bare LED chips. The LED elements may be disposed in different configurations and/or layouts as desired. Different color temperatures and appearances could be produced using other LED combinations, as is known in the art.

Further, any of the embodiments disclosed herein may include one or more communication components 11 forming a part of the light control circuitry, such as an RF antenna that senses RF energy. The communication components may be included, for example, to allow the luminaire to communicate with other luminaires and/or with an external controller such as a wireless remote control. More generally, the control circuitry includes at least one of a network component, an RF component, a control component, and a sensor. The sensor may provide an indication of ambient lighting levels thereto and/or occupancy within the illuminated area. The communication components such as a sensor, RF components or the like may be mounted as part of the housing or lens assembly. Such a sensor may be integrated into the light control circuitry. The communication components may be connected to the lighting device 1 via a 7-pin NEMA photocell receptacle 15 or other connection. In various embodiments described herein various smart technologies may be incorporated in the lamps as described in the following United States patent applications "Solid State Lighting Switches and Fixtures Providing Selectively Linked Dimming and Color Control and Methods of Operating," U.S. Pat. No. 8,736,186, issued May 27, 2014, which is incorporated by reference herein in its entirety; "Master/Slave Arrangement for Lighting Fixture Modules," U.S. Pat. No. 9,572,226, issued Feb. 14, 2017, which is incorporated by reference herein in its entirety; "Lighting Fixture for Automated Grouping," U.S. Pat. No. 9,155,165, issued Oct. 6, 2015, which is incorporated by reference herein in its entirety; "Multi-Agent Intelligent Lighting System," U.S. Pat. No. 8,975,827, issued Mar. 1, 2013, which is incorporated by reference herein in its entirety; "Routing Table Improvements for Wireless Lighting Networks," U.S. Pat. No. 9,155,166, issued Oct. 6, 2015, which is incorporated by reference herein in its entirety; "Commissioning Device for Multi-Node Sensor and Control Networks," U.S. Pat. No. 9,433,061, issued Aug. 30, 2016, which is incorporated by reference herein in its entirety; "Wireless Network Initialization for Lighting Systems," U.S. Pat. No. 8,829,821, issued Sep. 9, 2014, which is incorporated by reference herein in its entirety; "Commissioning for a Lighting Network," U.S. Pat. No. 8,912,735, issued Dec. 16, 2014, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," U.S. Pat. No. 9,622,321, issued Apr. 11, 2017, which is incorporated by reference herein in its entirety; and "Enhanced Network Lighting," Application No. 61/932,058, filed Jan. 27, 2014, which is incorporated by reference herein in its entirety. Additionally, any of the light fixtures described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated by reference herein.

The LEDs 2 may emit light when energized through the electrical path and the light may be delivered to an optical element 8 for further treatment and distribution of the light. The optical element 8 may be used to mix the light emitted by the LEDs and to emit the light in a directional manner to produce a desired luminance pattern.

The optical element 8 may comprise, for example, a waveguide formed of any suitable waveguide material including acrylic, silicone, polycarbonate, glass and/or other suitable optically transmissive materials operable to support total internal reflection (TIR). The waveguide can have any geometry consistent with the desired luminance distribution patterns of the lighting device in conjunction with spacing of the LED light sources 2 along the waveguide perimeter. The waveguide can exhibit a circular, elliptical or polygonal geometry including, but not limited to, square, rectangular, pentagonal or hexagonal or other shapes.

The waveguide 8 includes light extraction components 10 on or along one or more surfaces of the waveguide. In other embodiments, the light extraction components can be within the waveguide body. In some embodiments, the light extraction component resides on one or more faces of the waveguide. The light extraction components can comprise a single light extraction element or a plurality of individual light extraction elements. The size, shape and/or density of individual light extraction components 10 can be uniform or vary across one or more surfaces of the waveguide body in a regular or irregular fashion to produce desired light emission pattern. The light extraction components 10 can comprise indents, depressions, facets or holes extending into the waveguide, or bumps, facets or steps rising above the waveguide surface, or a combination of both bumps and depressions. The light extraction components 10 can be part of the waveguide body or coupled to surfaces of the waveguide body. In some embodiments, individual light extraction components 10 have a symmetrical shape or geometry. The light extraction components 10 can be arranged in an array, and may exhibit regular or irregular spacing.

While one example of an optical element 8 has been shown and described as a waveguide that uses TIR to distribute and control the emission of light from the lighting device, the optical element may comprise any suitable optical element or combinations of optical elements including lenses, reflectors, TIR optical elements or the like.

Moreover, the optical element 8 may have a wide variety of shapes, sizes and configurations.

Lighting device 1 may comprise a passive heat management system for dissipating heat from the system components such as a heat sink 14. The heat sink 14 may comprise a thermally conductive material such as aluminum and may be thermally coupled to the LEDs 2 and to other system components and may be at least partially exposed to the ambient environment to dissipate heat from the system components. The heat sink 14 may comprise fins for facilitating the dissipation of heat to the ambient environment.

The various system components may be retained in a housing 16. In the illustrated embodiment the housing includes a pivoting door 16*a* that may be pivoted between open and closed positions to allow access to the internal components of the lighting device 1. The housing 16 may be mounted on a support structure 18 such as a pole although any suitable mounting structure may be used. The lighting device 1 is an embodiment of a solid state lighting device suitable for use in outdoor applications; however, the system of the invention may be used in any solid state lighting device. Moreover, while a lighting fixture is shown and described the invention may be used in any solid state lighting device including lamps, bulbs, troffer-style lights or the like.

The power supply or driver 6 is in the electrical path to the LEDs 2. The driver 6 may be mounted on the LED board 4 or it may be mounted on a separate lamp electronics board 20 where the lamp electronics board is electrically coupled to the LED board 4 and is in the electrical path to the LEDs. LED lighting systems can work with a variety of different types of power supplies or drivers. For example, the driver circuit 18 may comprise a buck converter, boost converter, buck-boost converter, or single ended primary inductor converter (SEPIC) could all be used as driver or a portion of a driver for an LED lighting device or solid-state lamp. The driver 6 rectifies high voltage AC current to low voltage DC current, and regulates current flow to the LEDs. The power source can be a battery or, more typically, an AC source such as the utility mains.

The power supply 6 may also comprise a dimming circuit 20 for controlling the dimming of the LEDs 2. Generally speaking the amount of current flowing through an LED device determines the light output such that brightness may be controlled by controlling the current passing through the layers of semiconductor material. The driver may dim the LEDs using pulse-width modulation (PWM) where the current sent through an LED is switched on and off at a high frequency, amplitude modulation (AM) or the LEDs may be dimmed through constant current reduction (CCR). CCR maintains a continuous current to the source, but it reduces its amplitude to achieve dimming which may cause a color shift of the LEDs. PWM avoids color shift by operating the LED at its rated current level and at zero current. Combinations of AM and PWM may also be used. While the driver circuit 18 and the dimmer circuit 20 are represented as separate blocks in FIG. 4, the functionality of the dimming circuit and the driver circuit may be incorporated in a single circuit as part of the same physical component.

Control of the dimming of the LEDs may operate either by an external signal or by internal controls or by a combination of both. For example, dimming may be controlled by receiving an external signal from an external source such as a dimming switch, ambient light detector or the like via communication component 15, a hard wired connection or the like. The communication components 11 and systems that form a part of the light control circuitry, such as an RF antenna that senses RF energy as described previously may be used to control dimming of the LEDs.

Figure 3:
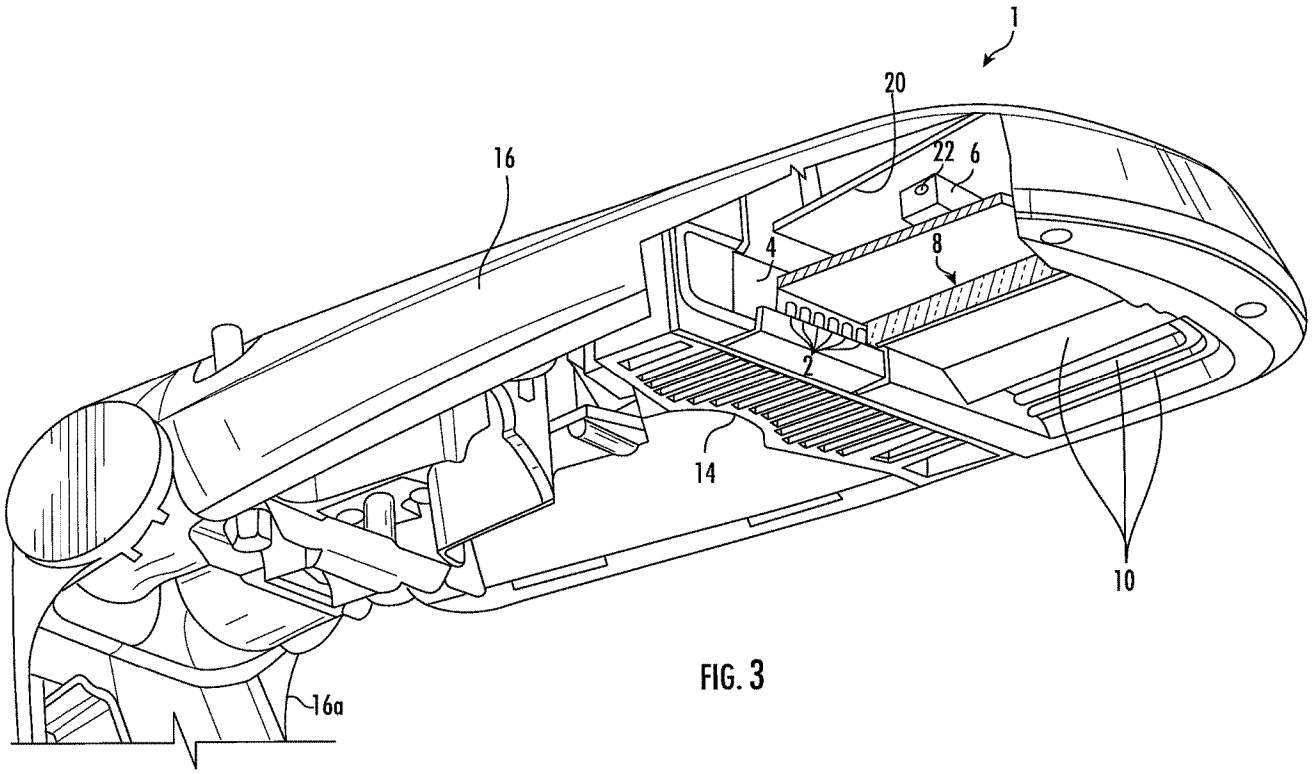
FIG. 3 is a partial cut-away view of the lighting device of FIG. 1 showing some of the internal components of the lighting device.
Figure 4:
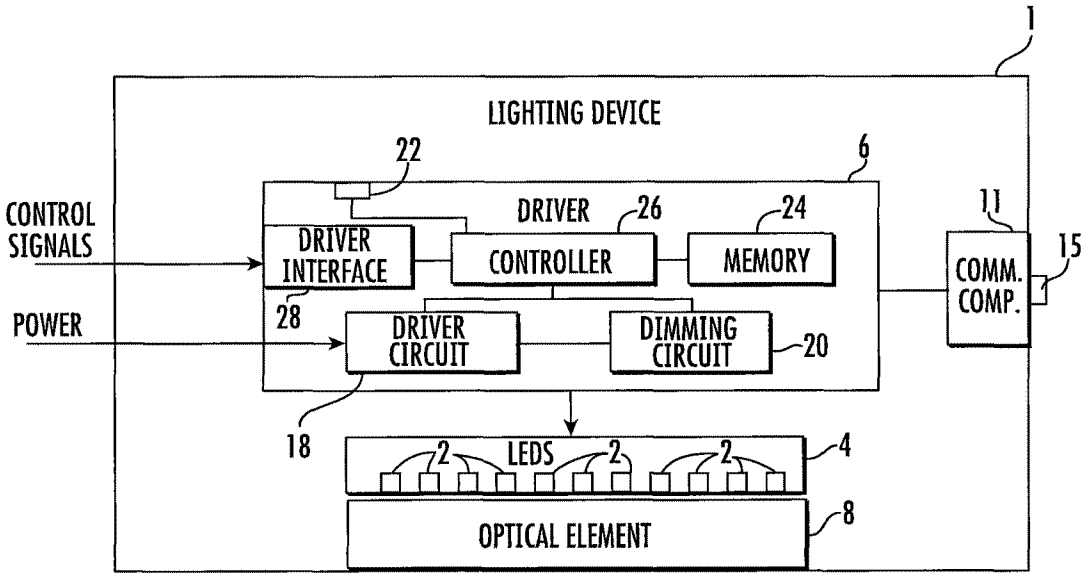
FIG. 4 is a diagram of an embodiment of a lighting device.

Dimming may also be controlled internally as a power saving or thermal management tool. Heat may adversely affect the operation of a LED lighting device. Excessive heat may degrade the performance of, or cause a failure of, the system components such as, but not limited to, the LEDs 2, the optical element 8 and/or driver 6. The problem of heat management may be more problematic when the lighting device is used in non-climate controlled environments such as outdoors where the lighting devices may be subject to large temperature variations, sunlight and high ambient temperatures. Moreover, in some applications, for example, high power applications where a high lumen output is required the power density of the LED board may create high local temperatures. In some applications a relatively large number of closely spaced LEDs may be contained in a small area and may be located close to the optical element 8 as shown in FIG. 3. The heat of the LED board 4 and the heat of the LED flux from the LEDs 2 may cause the optical element 8 to heat significantly faster than the driver 6 or other system components. Thus, in addition to the overheating of the lamp electronics such as the driver and the overheating of the LEDs, overheating of other related system components such as the optical element may be a concern.

Some existing drivers have a fixed temperature limit at which the driver will begin to automatically reduce the current delivered to the LEDs. The fixed temperature limit, sometimes referred to as the driver case temperature, is set by the driver manufacturer and is based on the maximum temperature limit for the driver itself. Typically, the driver case temperature is related to the safe operating specifications of the driver and may be related to the UL (Underwriters Laboratories) rating of the driver. In such a system, the driver senses the temperature at a specific point on the driver case using a sensor 22 such as a thermocouple that is attached to the driver case. The driver reduces the power to the LEDs to thereby lower the driver case temperature when the driver case temperature reaches a set temperature limit. While such a driver specific temperature limit protects the driver, it does not necessarily protect the entire system or other components in the system. As result, lighting devices must utilize one of the more extensive secondary thermal management system such as the thermistor feedback system discussed previously if system overheating is to be avoided. The use of additional components and circuitry to add a secondary thermal management system increases the cost of the lighting device and lowers reliability.

In some embodiments the driver 6 may comprise a programmable driver. A programmable driver may comprise a memory device 24, a controller 26, a programmable interface 28 in addition to the power supply circuitry 18, 20 that controls the current and voltage delivered to the LEDs. Embodiments of the invention may operate under control of a programmed controller, such as a microprocessor, microcontroller or the like. The present system has particular utility with a programmable driver because the temperature limit can be easily programmed for the driver based on the thermal characteristics of the lighting device. As a result a single driver may be used with a variety of different types of lighting devices where the different types of lighting devices have different thermal characteristics. The correlated temperature limit of the driver may be easily reprogrammed in the driver as will hereinafter be described for each type of lighting device. As will be appreciated by one of skill in the art, executable code to carry out the processes illustrated may be embodied as a method, article, system, computer program product, or a combination of the foregoing. Any suitable tangible computer usable or computer readable medium may be utilized for a non-transitory computer program product to implement an embodiment of the invention. Firmware or computer program code to cause controllers or processors to execute the described processes may be stored in memory either within or externally connected to the controllers or a controller in a solid state lamp.

While the system is described with respect to a programmable driver, the system may be implemented with a non-programmable driver where the control logic is imbedded into the driver circuitry. The controller may be an ASIC, or even a "processor" comprising dedicated circuits, with or without firmware. Depending on the embodiment, other control circuitry can be used using discrete analog and/or digital devices or any combination thereof. Such circuitry for purposes of this disclosure can also be referred to as a controller. However, where a non-programmable controller is used, a lighting device specific driver having a specific temperature limit must be used with each different type of lighting device that has different thermal characteristics. The non-programmable driver would only be rated to be used with the specific temperature limit integrated into the controller such that some of the benefits of the invention provided by using a programmable driver may be lost. With a programmable driver the driver may be programmed to operate at any correlated temperature limit provided that the correlated temperature limit is below the safe operating driver case temperature limit. The programmable driver may be programmed for each type of lighting device and each driver may be individually programmed for the lighting device with which it is used.

Programmable drivers allow the lighting device designer to configure the driver using a programming interface 28 such as a DALI (Digital Addressable Lighting Interface) protocol as set out in the technical standard IEC 62386, a wireless interface, a proprietary interface or other interface technology. For example, using a programmable driver a temperature limit at which the output current from the driver is reduced or switched off may be set. The programmable driver may be programmed to set the temperature at which dimming starts, the temperature at which dimming stops, the temperature at which the LEDs will be turned off, the rate of dimming or the like. Programmable drivers may be configured to set other parameters of the driver operation in addition to the dimming function such as the maximum and minimum voltage and current the driver can deliver to the LEDs, light output levels, start time, operating hours or the like. One suitable driver that may be used is the DTL Xitanium Programmable Driver sold by Phillips.

The system of the invention correlates the thermal limit of the lighting device or a component of the lighting device to the temperature of the driver as sensed by the driver sensor 22. The correlated temperature limit of the driver 6 can be correlated to any component in the system that has a maximum temperature limit that is lower than the temperature limit of the driver or that has a maximum temperature limit may be reached before the temperature limit of the driver is reached. In the system shown in FIGS. 1-4 the LED board 4 may be thermally coupled to the aluminum heat sink 14 while the driver 6 and optical element 8 may not be directly thermally coupled to the heat sink. As a result the thermal characteristics of the lamp electronics board 20, driver 6 and optical element 8 may be different from one another and different than the thermal characteristics of the LED board 4 and LEDs 2 such that the temperature of the driver at any point in time may be different than the temperature of other system components. While the temperatures of the components may be different than one another at any point in time of the operation of the lighting device, the temperatures of the components are related to one another such that it is possible to correlate the temperatures of the various components to one another.

In some embodiments, the driver temperature limit is correlated to a temperature sensitive component that is not closely thermally linked to the driver. If the temperature sensitive component and the driver are closely thermally coupled the temperature of the component and the temperature of the driver may be very close and there may be no need to correlate the temperature limits if the temperature limit of the component is higher than the temperature limit of the driver; however, where the driver and system component are not closely thermally coupled the temperature of the system component and the temperature of the driver may be significantly different at any time during operation of the lighting device such that correlation of the temperature of the driver and the system component's upper temperature limit may be advantageous. However, the system of the invention may be used with any component whether closely thermally coupled to the driver or not.

For example, in the system described with reference to FIGS. 1-4, the optical element 8 may heat up more quickly than the driver 6 due to the high power density of the LED board 4 and the closeness of the optical element 8 to the LEDs 2. In such a situation the temperature limit of the optical element 8 may be reached before the driver 6 reaches its internal temperature limit even if the driver temperature limit is lower than the optical element temperature limit. If the thermal control system of the lighting device relied on the temperature limit of the driver to control overheating, the performance of the optical element 8 would degrade before the driver temperature limit was reached. While the invention has been described with the respect to the optical element 8, the temperature of the driver can be correlated to any component in the system that has a maximum temperature limit that is lower than the temperature limit of the driver or that has a temperature limit that may be reached before the temperature limit of the driver is reached. The component to which the driver temperature is correlated may be referred to herein as a "temperature sensitive component."

During the design of the lighting device 1, the temperature of the driver is correlated to the temperature limit of at least one other temperature sensitive component. The temperature sensitive component may be the component that has the lowest upper temperature limit or the component where the temperature limit of the component is reached before the temperature limit of the driver is reached. The driver temperature may be correlated to any component where overheating may cause a failure or degradation of the component or the lighting system itself.

In a typical driver with overheating protection, the driver dims or turns off the LEDs when the driver temperature limit is reached. This arrangement protects the driver from overheating but does not account for other temperature sensitive components in the system. In the system of the invention the driver is programmed such that the LEDs are dimmed, or turned off, when the temperature limit of the temperature sensitive component is reached whether or not the temperature limit of the driver is reached. The temperature limit of the temperature sensitive component is correlated to the actual driver temperature such that the driver reduces power to the LEDs when the temperature limit of the temperature sensitive component is reached by reducing power at the correlated temperature. This is accomplished without using a separate temperature sensor for the temperature sensitive component.

To set the correlated temperature at the driver, the lighting device is operated to raise the temperature of the lighting device (Block 501). The lighting device may be operated at its normal operating power level and subj ected to a high temperature ambient environment or the lighting device may be operated at higher power levels or a combination of both. In all events the lighting system is operated to raise the temperature in the system higher than normal operating conditions. The lighting system may be operated to create thermal temperatures in the system that cannot be adequately dissipated using the passive thermal management system such as heat sink 14. The temperature of at least one temperature sensitive component is monitored and measured (Block 502). In some embodiments, the most temperature sensitive component may be known prior to setting the correlated temperature in which case the temperature of a single temperature sensitive component may be monitored. In other embodiments the temperature of multiple temperature sensitive components are individually monitored and measured to determine which component reaches its temperature limit first. The component that reaches its temperature limit first may be considered the temperature sensitive component. The temperature of the driver is also monitored and measured (Block 503). The temperatures of the temperature sensitive component and the driver are monitored and measured either continuously or intermittently until the actual temperature of the temperature sensitive component reaches the temperature limit for that component. The actual temperature of the driver and the actual temperature of the temperature sensitive components may be monitored by any suitable temperature sensors. In some embodiments the driver case sensor 22 may be used to monitor and detect the temperature of the driver. The lighting device is operated until the actual temperature of the temperature sensitive component reaches the temperature limit of that component (Block 504). For example, if the optical element 8 is the temperature sensitive component the system monitors and detects the temperatures of the driver 6 and the optical element 8. When the temperature sensitive component (e.g. the optical element 8) reaches its temperature limit, the actual temperature of the driver is determined (Block 505). At this point the temperature limit of the temperature sensitive component is correlated to the actual temperature of the driver. The actual temperature of the driver 6 when the temperature sensitive component (e.g. the optical element 8) reaches its temperature limit is the correlated temperature. The driver 6 is programmed with the correlated temperature (Block 506). The programmed correlated temperature is the temperature limit at which the driver reduces power to the system and initiates the dimming of the LEDs to prevent overheating of the temperature sensitive component. It should be noted that the correlated temperature may include a margin of error such that the correlated temperature is the actual temperature of the driver when the temperature sensitive component (e.g. the optical element 8) reaches its temperature limit minus a safety factor. The term correlated temperature is intended to encompass both the actual correlated temperature and the correlated temperature including a margin of error provided that the correlated temperature is based on the actual temperature of the driver when the temperature sensitive component's temperature limit is reached and is the temperature used to initiate dimming of the LEDs to prevent overheating. The correlated temperature may be programmed into each individual driver for every individual lighting device having the same thermal characteristics. For lighting devices having different thermal characteristics the same driver may be programmed with a different correlated temperatures. As a result, the system of the invention, when used with a programmable driver, may easily change the correlated temperature when the temperature characteristics of the lighting device change or when the driver is used with a different lighting device with different temperature characteristics. In this manner a single driver may be used across a wide range of lighting devices by selectively programming the correlated temperature.

For explanatory purposes, assume that the driver's rated temperature limit (driver case limit) is 85° C. The correlated temperature may be any temperature lower than the driver temperature limit of 85° C. The driver temperature limit may be the temperature limit at which the driver may be safely operated and in some embodiments may be the rated temperature of the driver such as the UL limit. Assume further that temperature sensitive component's upper temperature limit is 90° C. On its face it would appear that the driver temperature limit of 85° C. would be reached before the temperature sensitive component's upper temperature limit of 90° C. is reached. However, further assume that the temperature sensitive component heats up more rapidly than the driver such that the temperature limit of the temperature sensitive component is reached before the temperature limit of the driver is reached. For example, the temperature of an optical element 8 in a lighting device 1 as shown in the drawings may heat up more quickly than the driver 6 due to the high power density of the LED board 4, the closeness of the optical element 8 to the LEDs 2, the effects of the ambient temperature and the fact that the driver and optical element are not directly thermally coupled to the heat sink 14. As a result, the temperatures of the driver 6 and optical element 8 may be different at any point during operation of the lighting system. While the temperatures of the various system components may be different, the temperatures of the system components are related to one another such that at any given temperature of one component (e.g. the optical element 8) the temperature of another component (e.g. the driver 6) is known. Thus, in the example provided when the temperature sensitive component reaches its upper temperature limit of 90° C. the actual driver case temperature may only be at 80° C. Under the existing systems the driver would continue to operate at full power resulting in potential damage to, or failure of the temperature sensitive component, unless additional temperature feedback was provided from the temperature sensitive component to the driver control. Under the system of the invention the sensitive component's upper temperature limit of 100° C. is correlated to the driver case temperature of 80° C. where 80° C. is the correlated temperature. The driver 6 reduces power output using the dimming circuit, or turns of the power to the LEDs completely, when the correlated temperature is reached at the driver. In this manner, the more temperature sensitive component is protected from overheating even if the rated case temperature limit of the driver is not reached, without the need for additional temperature sensors and related feedback circuitry in the system. In the example given above the temperature sensitive component's upper temperature limit was above the driver case temperature limit but was reached before the driver case temperature limit was reached. In other embodiments the temperature sensitive component's upper temperature limit may be below the driver case temperature limit where the temperature sensitive component heats up at the same rate or even more slowly than the driver. The system of the invention may be advantageously used in any lighting system where a component may be damaged or the performance of a component may be degraded due to overheating.

Figure 5:
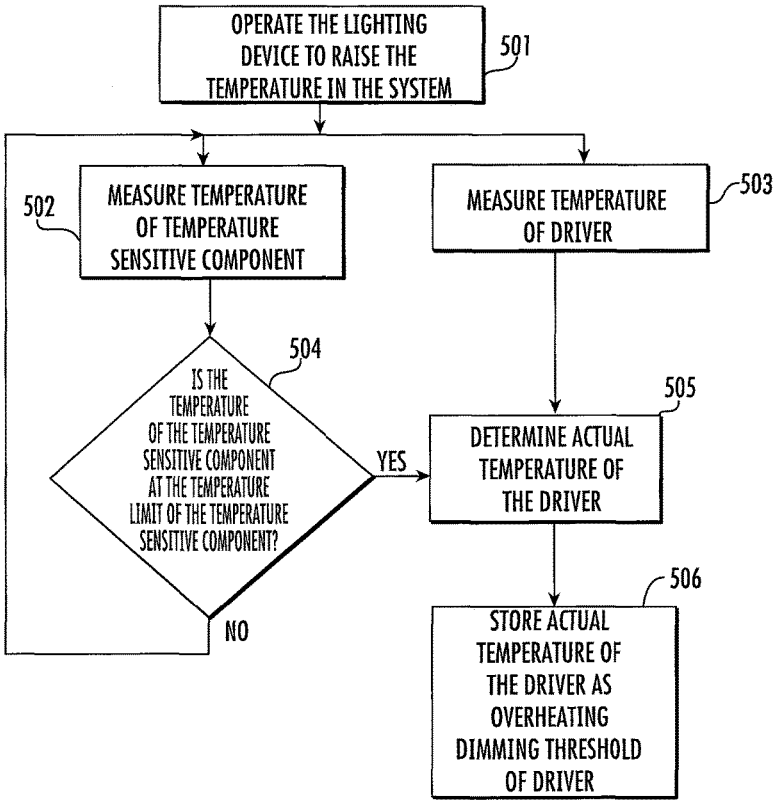
FIG. 5 is a flow chart illustrating the set-up of the system of the invention.
Figure 6:
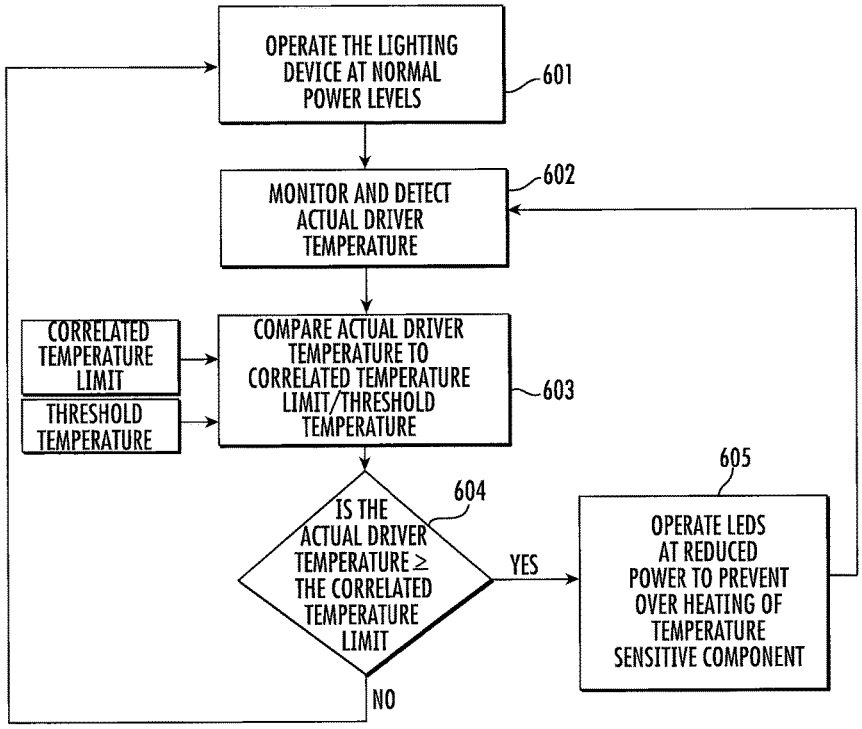
FIG. 6 is a flow chart illustrating the operation of the system of the invention

Once the correlated temperature is programmed in the driver 6, the system operates as follows. The lighting device is operated at normal power levels (Block 601). The normal power levels may be considered full normal power; however, the lighting device may be operated at less than full power for reasons other than overheating. For example, the lighting device may be operated based on ambient light levels where the LEDs are dimmed or turned off based on the ambient light, the LEDs may be dimmed or turned off based on a user control, the LEDs may be dimmed or turned off based on time of day or the LEDs may be dimmed or turned off based on other parameters. All of these situations would be considered normal "full power" operation in that the LEDs are operated at full power based on the operating parameters of the lighting device. The driver continuously monitors the actual driver temperature during normal operation using sensor 22 (Block 602) and provides the actual driver temperature to controller 26 as an input. The driver temperature may be monitored continuously or it may be monitored periodically provided that changes in the driver temperature can be detected in a timely manner to protect overheating of the lighting system components. The actual driver temperature detected by sensor 22 is compared to the set correlated temperature (Block 603). The correlated temperature (Block 607) is stored in memory and is retrieved by the controller 26 to make the comparison. The sensing of the driver temperature and the comparison of the actual driver temperature to the correlated temperature is performed in the driver by controller 26. If the actual detected driver temperature is less than the correlated temperature (Block 604) the driver operates the LEDs at normal power levels (Block 601). If the actual detected driver temperature is equal to or greater than the correlated temperature (Block 604) the driver reduces the power to the LEDs to thereby produce less heat (Block 605). As previously explained the reduction in power may result in the dimming of the LEDs using the dimming circuit or it may result in the turning off some or all of the LEDs. The power reduction profile for the overheating condition may be stored in memory 24 and may operate as a continuous curve, stepped reduction or the like provided the temperature is reduced in a manner to prevent overheating of the temperature sensitive component. The slope of the curve as well as the value of the reduction may be stored in memory 24 and used by controller 26 to control the power delivered to the LEDs. The driver 6 continuously or periodically monitors the actual driver temperature using sensor 22 during the power reduction operation (Block 602). The actual driver temperature is compared to the set correlated temperature at the driver (Block 603). If the actual detected driver temperature is less than the correlated temperature (Block 604) the driver returns operation of the LEDs to normal power levels (Block 601). If the actual detected driver temperature is equal to or greater than the correlated temperature (Block 604) the driver maintains the reduced power to the LEDs or reduces the power further (Block 605). This process is continued until the temperature at the driver falls below the correlated temperature, or falls below a threshold temperature (Block 608) that may be below the correlated temperature. The threshold temperature for returning the LEDs to normal power operation may be the same as the correlated temperature used to initiate power reduction or it may be slightly lower than the correlated temperature. The temperature at which power to the LEDs is raised to normal levels after being reduced to prevent overheating may be considered the threshold temperature and may be programmed into controller during the setup operation described with respect to FIG. 5.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lighting device comprising at least one LED operable to emit light when energized through an electrical path, comprising:

a temperature sensitive component having a temperature limit;

a driver in the electrical path for controlling current delivered to the at least one LED, the driver comprising a temperature sensor for determining a temperature of the driver and not the temperature of the temperature sensitive component, the temperature of the driver being different than the temperature of the temperature sensitive component; and a controller storing a correlated temperature limit of the driver, the controller controlling the driver to reduce the current delivered to the at least one LED when a correlated temperature limit is reached, the correlated temperature limit being related to the temperature limit whereby overheating of the temperature sensitive component is prevented.

2. The lighting device of claim 1, wherein the temperature sensitive component comprises at least one of: the at least one LED and an optical element.

3. The lighting device of claim 2, wherein the optical element is a TIR optical element.

4. The lighting device of claim 1, wherein the driver comprises at least one of a buck converter, boost converter, buck-boost converter, or single ended primary inductor converter.

5. The lighting device of claim 1, wherein the driver comprises dimming control circuitry.

6. The lighting device of claim 1, wherein the driver comprises a programmable driver.

7. The lighting device of claim 1, wherein the correlated temperature is the temperature of the driver when the temperature of the temperature sensitive component reaches the temperature limit.

8. The lighting device of claim 1, wherein the correlated temperature includes a margin of safety.

9. The lighting device of claim 1, wherein the driver has a temperature limit and the correlated temperature is lower than the temperature limit of the driver.

10. The lighting device of claim 1, wherein the controller stores a threshold temperature, the controller controlling the driver to increase the current delivered to the at least one LED when the threshold temperature is reached.

11. The lighting device of claim 1, wherein the driver has a driver temperature limit and the temperature limit of the temperature sensitive component is higher than the driver temperature limit.

12. A method of operating a lighting device comprising a temperature sensitive component comprising at least one of an optical element and at least one LED, the method comprising:

energizing the at least one LED through an electrical path to emit light;

operating a driver in the electrical path to control current delivered to the at least one LED, sensing the temperature of the driver and not the temperature of the temperature sensitive component; and storing a correlated temperature limit, the correlated temperature limit being related to the temperature limit of the temperature sensitive component other than the driver, the temperature of the driver being different than the temperature of the temperature sensitive component;

controlling the driver to reduce the current delivered to the LEDs when the temperature of the driver reaches the correlated temperature limit, whereby overheating of the temperature sensitive component is prevented.

13. The method of claim 12, wherein the correlated temperature is the temperature of the driver when the temperature of the temperature sensitive component reaches the temperature limit.

14. The method of claim 13, wherein the correlated temperature includes a margin of safety.

15. The method of claim 12, further comprising increasing the current delivered to the LEDs when a threshold temperature is reached.

16. A method of making a lighting device having at least one LED and a driver for controlling current delivered to the at least one LED comprising:

measuring a first temperature of at least one temperature sensitive device;

measuring a second temperature at the driver;

determining a correlated temperature of the second temperature when the first temperature reaches a temperature limit of the temperature sensitive device; and storing the correlated temperature to control the operation of the driver.

17. The method of claim 16, operating the lighting device to raise the temperature in the system higher than normal operating conditions.

18. The method of claim 16, wherein the step of measuring a first temperature of at least one temperature sensitive device comprises the measuring of the first temperature of multiple temperature sensitive components.

19. The method of claim 16, further comprising programming the correlated temperature in the driver.

* * * * *